US005309875A

United States Patent [19]

Gault

[11] Patent Number: 5,309,875

[45] Date of Patent: May 10, 1994

[54] INTERNALLY VENTED FLOAT BOWL CARBURETOR HAVING A COLD START VENT CONDUIT

[75] Inventor: Roger T. Gault, Chilton, Wis.

[73] Assignee: Tecumseh Products Company, Tecumseh, Mich.

[21] Appl. No.: 996,680

[22] Filed: Dec. 24, 1992

[51] Int. Cl.[5] ..... F02M 1/10

[52] U.S. Cl. ..... 123/179.16; 261/DIG. 67

[58] Field of Search ..... 123/179.16, 179.13, 123/179.15; 261/DIG. 67, 72.1

[56] References Cited

U.S. PATENT DOCUMENTS

| | | | |
|---|---|---|---|
| 1,785,681 | 12/1930 | Goudard . | |
| 2,793,634 | 5/1957 | Ericson | 123/179 |
| 2,839,154 | 5/1958 | Sterner | 183/20 |
| 2,985,159 | 5/1961 | Moseley | 123/179.16 |
| 3,706,444 | 12/1972 | Masaki et al. | 261/39 D |
| 3,780,996 | 12/1973 | Nutten | 261/72 |
| 3,872,851 | 3/1975 | Matsumoto et al. | 123/179.13 |
| 4,040,399 | 8/1977 | Meininger | 123/65 R |
| 4,089,311 | 5/1978 | Brettschneider et al. . | |
| 4,254,064 | 3/1981 | Bernauer et al. | 261/64 E |
| 4,323,522 | 4/1982 | Rasmussen | 261/72 R |
| 4,360,481 | 11/1982 | Kaufman | 261/39 R |
| 4,499,032 | 2/1985 | Shibano | 261/72 R |
| 4,679,534 | 7/1987 | Guntly | 123/187.5 |
| 4,703,739 | 11/1987 | Yogo | 261/DIG. 67 |
| 4,926,808 | 5/1990 | Kandler | 123/187.5 |

FOREIGN PATENT DOCUMENTS

| | | | |
|---|---|---|---|
| 57-176346 | 10/1982 | Japan | 123/179.16 |

*Primary Examiner*—Andrew M. Dolinar
*Attorney, Agent, or Firm*—Baker & Daniels

[57] ABSTRACT

An internal combustion engine having a carburetor including a float bowl that is internally vented through a venting path that extends from the carburetor bore to the headspace above the fuel in the bowl. An external bowl vent passageway extends through the carburetor body to permit air communication between the atmosphere external of the carburetor and the headspace. A thermally actuated valve is secured to a sheet metal cowling on the engine. A flexible tube is secured from the external vent passageway to the valve. While the engine is cold, the valve is open to permit the float bowl to be externally vented to the atmosphere, thereby providing a relatively rich fuel mixture which aids in starting the engine. Upon sustained engine operation and the attainment of a predetermined temperature, the valve closes the external vent passageway, thereby causing the float bowl to be internally vented only, thereby leaning out the fuel/air mixture to a desired emissions level during engine operation.

10 Claims, 4 Drawing Sheets

INTERNALLY VENTED FLOAT BOWL CARBURETOR HAVING A COLD START VENT CONDUIT

BACKGROUND OF THE INVENTION

The present invention relates generally to carburetors for internal combustion engines, and more specifically to internally vented float bowl carburetors.

In a typical float bowl type carburetor, fuel flows from the reservoir in the float bowl through a fuel metering orifice into a fuel well from which the fuel is drawn up and mixed with air due to the pressure differential caused by the venturi region in the carburetor bore or throat. Since a continuous flow of fuel from the float bowl to the venturi must be provided in order to assure smooth engine operation, it is necessary to maintain a consistent fuel level in the float bowl. In order to maintain a consistent fuel level, a float control valve arrangement is provided such that as the fuel level in the float bowl is depleted through normal operation, the float control valve opens a conduit connected to a larger fuel storage tank. As fuel is replaced in the float bowl, an excess pressure is created above the fuel level. A proper fuel flow rate is facilitated by venting the excess pressure from the top of the float bowl to a constant pressure region. This venting may be to the atmosphere external of the carburetor (external venting) or to a region of relatively constant pressure within the carburetor bore (internal venting). Both types of venting arrangements are well known in the art.

Internally vented float bowl arrangements are advantageous to externally vented bowls in that air that is supplied to the vent has already passed through the carburetor air filter so that the likelihood of introducing additional contaminants into the carburetor is greatly reduced. In addition, in internally vented arrangements, as the air cleaner element becomes clogged and the pressure within the carburetor throat decreases, the pressure in the fuel bowl also decreases due to the passageway connecting the carburetor throat and the bowl, thereby leaning out the fuel-air mixture to a level proportional to the level that existed when the air cleaner element was unobstructed.

As government regulations require small internal combustion engines to limit exhaust gas emissions to a prescribed level, engines will be required to operate on a leaner fuel/air mixture than previously. Such leaner calibration requirements create difficulties in starting the engine. In engines operating on such leaner fuel/air mixtures, it may be necessary to prime and restart the engine several times before the engine temperature increases to the point where fuel is vaporized at a sufficient rate to permit sustained engine operation.

It is desired to provide an engine which operates on a leaner fuel/air mixture yet which can be started without excessive priming and/or startup attempts.

SUMMARY OF THE INVENTION

The present invention provides an internal combustion engine including a float bowl type carburetor arrangement, wherein the fuel bowl is vented externally to the atmosphere upon cold engine startup to aid in starting the engine, and wherein the fuel bowl is vented internally to the carburetor bore upon the attainment of a predetermined engine temperature, thereby leaning out the fuel/air mixture to a desired emissions level during engine operation.

Generally, the present invention provides an internal combustion engine having a carburetor that includes a float bowl that is internally vented through a venting path that extends from the carburetor bore to the headspace above the fuel in the float bowl. An external bowl vent passageway extends from the atmosphere to the headspace area. A thermally actuated valve is provided in the external vent passageway. While the temperature of the engine is less than a predetermined temperature, the valve is open to permit the float bowl to be externally vented. Upon sustained engine operation and the attainment of the predetermined temperature, the valve closes the external vent passageway, thereby causing the float bowl to be internally vented only.

More particularly, the present invention provides, in one form thereof, an external vent passageway formed within the body of the carburetor in communication with the internal vent passageway at a cavity region within the carburetor. One end of a flexible tube is attached to a boss portion through which the external passageway extends. The opposite end of the tube is attached to a thermally-actuated valve that is attached to the cylinder block of the engine. A temperature sensitive, snap-acting bimetallic disc is located in the valve and is in an open position when the engine is cold to permit communication of atmospheric air and the valve, the flexible tube and, subsequently, the float bowl. As the engine is started and reaches a predetermined temperature, the bimetallic disc snaps into airtight engagement with an o-ring seal to block air communication between atmospheric air and the air outlet conduit of the valve.

In an alternative embodiment, the present invention provides the above-described engine in which a second thermally-actuated valve is in air communication with the internal vent conduit. This second valve is in a closed position at cold ambient engine temperatures to close the internal vent conduit. Therefore, the open external vent provides maximum float bowl/venturi pressure differential. At a predetermined intermediate engine temperature, the valve in the internal vent opens so that both the internal and external vents act on float bowl pressure. At a predetermined higher engine temperature, the valve in the external vent closes to close the external vent conduit, thereby providing minimum float bowl/venturi pressure differential.

An advantage of the present invention is that a fuel-rich mixture is introduced into the intake system of the cold engine upon initial start-up, thus eliminating the need for excessive priming.

Another advantage of the present invention is that a leaner fuel mixture is automatically provided soon after sustained engine operation.

Other advantages will become apparent from the description to follow.

DESCRIPTION OF THE PREFERRED EMBODIMENT

Figure 1:
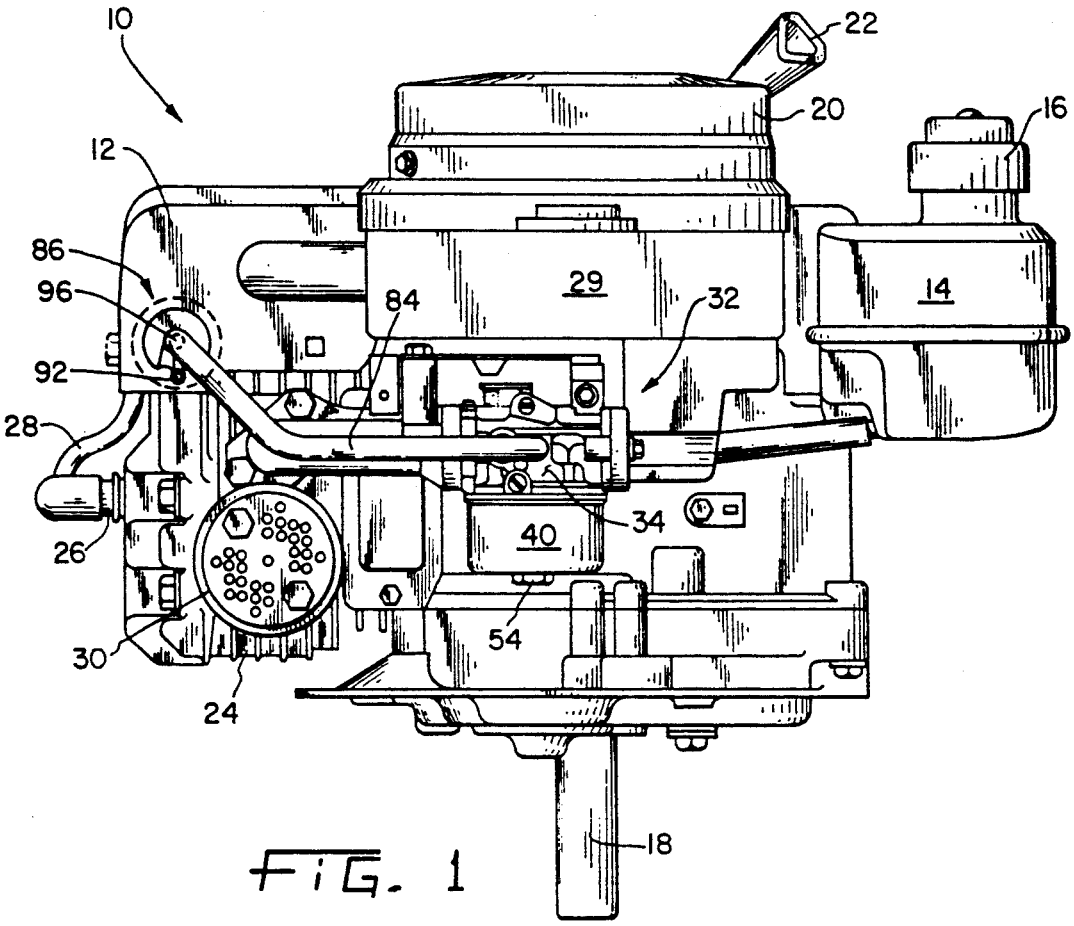
FIG. 1 is a front elevational view of a small internal combustion engine incorporating principles of one embodiment of the present invention.
Figure 2:
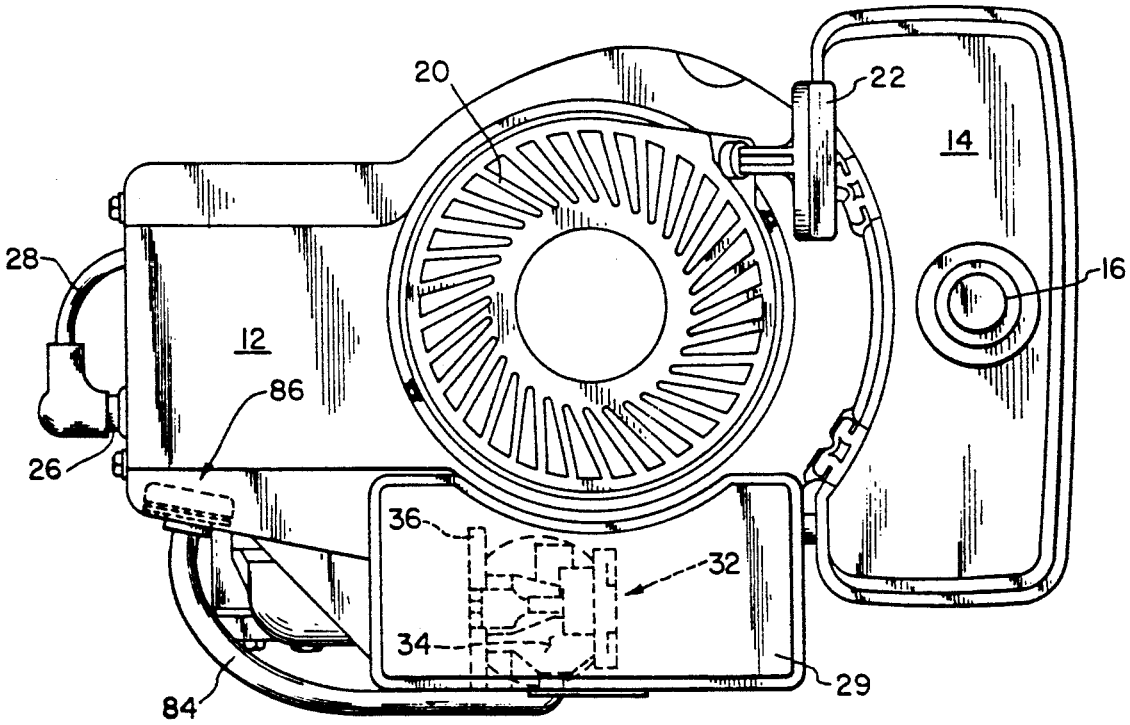
FIG. 2 is a top view of the engine of FIG. 1.

Referring now to the drawings, and in particular to FIGS. 1 and 2, there is shown a small internal combustion engine 10 of the vertical crankshaft variety as might be used to power a rotary lawnmower, for example. It is appreciated that the present invention may also be utilized in conjunction with horizontal crankshaft engines. Engine 10 includes a metal cowling or housing 12 and a fuel tank 14 including a fuel fill cap 16. Engine crankshaft 18 is keyed to the flywheel (not shown) which includes air circulating blades or vanes (not shown) for air cooling of the engine. The flywheel is enclosed within housing 12. A manual recoil starting arrangement (not shown) is positioned above the flywheel and is enclosed within starter housing 20. A pull start handle 22 extends from the top surface of starter housing 20.

Engine 10 further includes a cylinder block 24 and a spark plug 26 with ignition lead 28 to the engine ignition circuitry. Engine 10 also includes an air cleaner assembly 29; a muffler 30 and a carburetor 32 which shall be discussed further herein.

Figure 3:
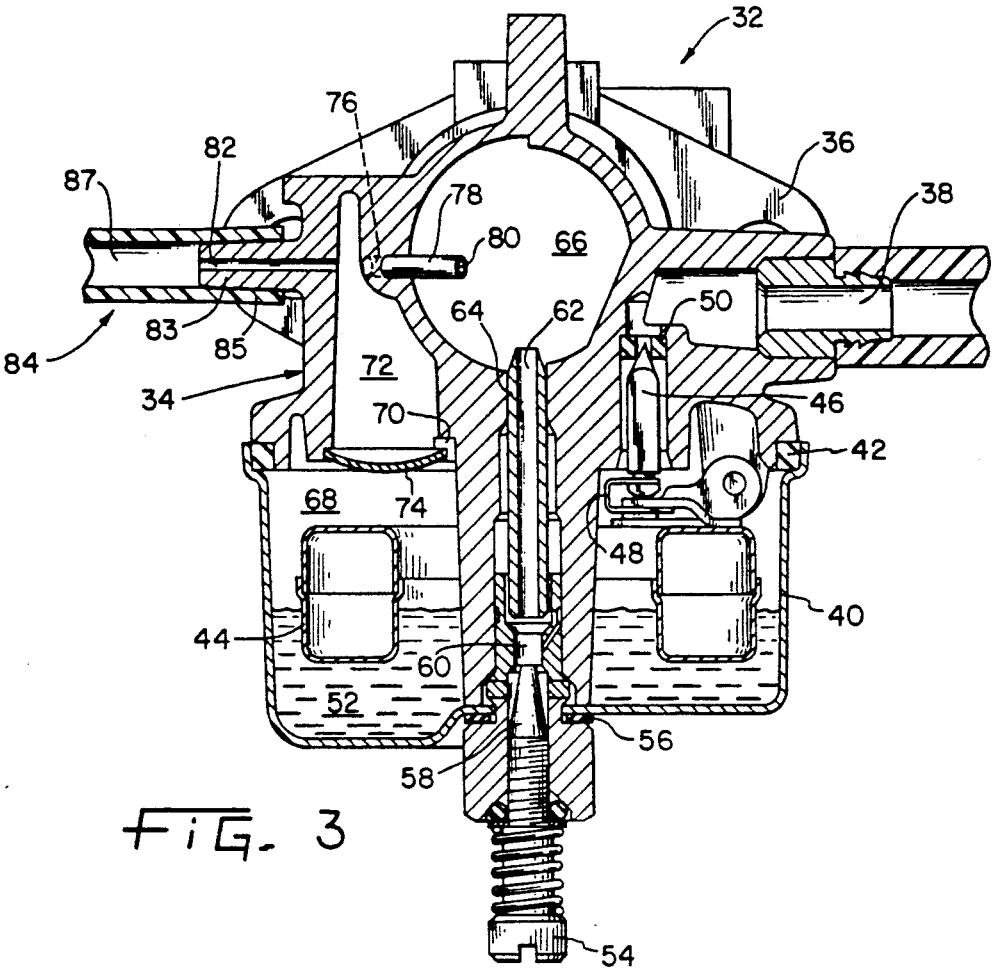
FIG. 3 is an enlarged longitudinal sectional view of the carburetor of the engine of FIG. 1.

Referring now to FIG. 3, carburetor 32 is shown in greater detail. Carburetor 32 includes a carburetor body 34 having a flange 36 bolted either directly to the engine or to an intake manifold thereof. Carburetor body 34 includes a fuel inlet passage 38 for emitting fuel into the carburetor. Air is supplied to the carburetor through an air filter (not shown) which attaches to an air cleaner mounting (not shown) on the air inlet side of the carburetor. Carburetor 32 has a float regulated fuel supply chamber or bowl 40 of conventional construction. Fuel bowl 40 is sealingly attached to carburetor body 34 by means of an O-ring seal 42. A float 44 which is connected to an inlet needle 46 by means of an inlet needle clip 48, controls needle 46 with respect to seat 50 to open the valve defined by the needle and seat and allow fuel to enter fuel bowl 40 when the level of fuel 52 drops sufficiently to open the valve.

Fuel bowl 40 includes an adapter nut 54 which is sealed to fuel bowl 40 by means of a sealing washer 56. A series of fuel passages (not shown) in carburetor body 34 and adapter nut 54 connect an annular insert 58 and fuel metering passage 60 with fuel 52. Metering passage 60 is also connected to a nozzle conduit 62 in nozzle 64 whereby fuel is drawn upwardly by means of the lower pressure existing in the fuel-air mixture passageway or venturi 66. This fuel is then mixed with air in venturi 66. This mixture is then drawn into engine 10 in conventional manner.

In order to vent excess pressure from headspace 68 above fuel 52 in bowl 40, an internal venting arrangement is provided. This venting arrangement minimizes variations in fuel mixture richness resulting from variations in air intake path restrictions, such as a buildup of dirt in the air filter. An internal venting effect into venturi 66 is thus provided to act a as a balancing or stabilizing factor to minimize these variations. Headspace 68 in bowl 40 is vented to the carburetor bore by an angled slot 70 formed in the sidewall of cavity 72, which is closed at its lower end by a welch plug 74. A passage 76 extends from the upper end of cavity 72 and communicates with a vent tube 78 which has a free open end 80 positioned in the air inlet bore (not shown) closely adjacent the outlet end of the air filter element and generally facing carburetor air inlet.

Figure 4:
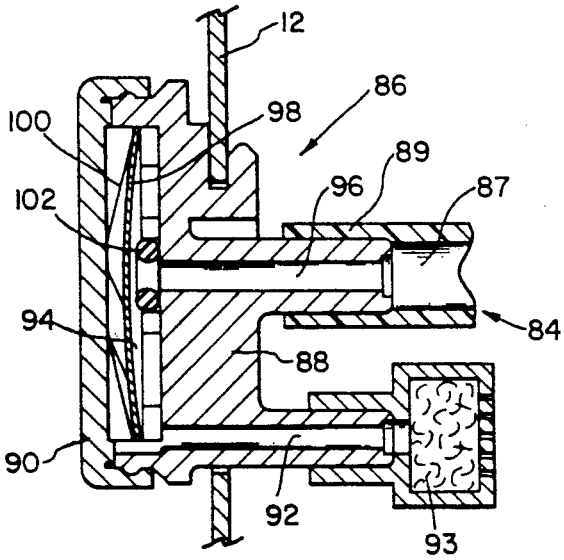
FIG. 4 is an enlarged cross sectional view of the thermal valve of the engine of FIG. 1, particularly showing the valve in its open position.
Figure 5:
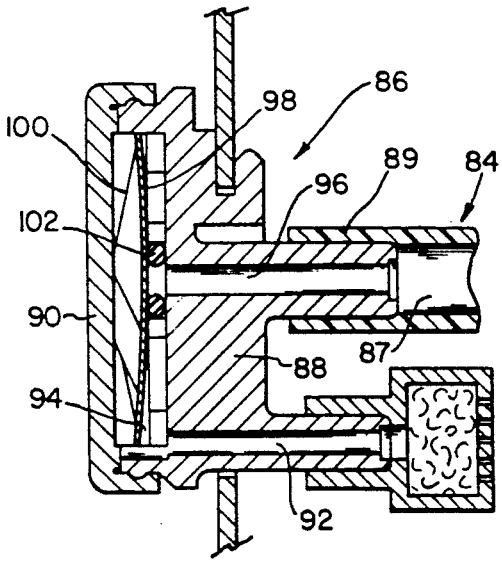
FIG. 5 is a view of the valve of FIG. 5, except that the valve is shown in its closed position.

In addition to the internal vent arrangement, an external venting arrangement is provided to aid in initial startup of the engine. In particular, a passageway 82 is formed within a boss portion 83 of carburetor body 34. Passageway 82 communicates at one end with cavity 72 and communicates at its other end with a flexible tube 84, preferably made of a coextrusion of epichlorohydrin and Buna N elastomers. In particular, end 85 of flexible tube 84 is frictionally secured to boss 83 and includes a conduit 87 therein that is in air communication with passageway 82. The opposite end 89 of tube 84 (FIGS. 4 and 5) is frictionally secured to a thermally activated valve 86 that is secured to housing 12, as shown in FIGS. 4 and 5. One type of valve that may be used is the "23V Thermal Vacuum Switch" manufactured by Therm-O-Disc, Inc. of Mansfield, Ohio.

As best shown in FIGS. 4 and 5, thermal valve 86 comprises a top casing 88 and a bottom casing 90, both preferably being made of nylon to prevent leaks therein. Valve 86 further includes an air inlet conduit 92 having a filter element 93 attached thereto, a valved conduit region 94, and an air outlet conduit 96 in communication with conduit 87 of tube 84. Valved conduit region 94 includes a temperature sensitive, snap-acting bimetallic disc 98 attached to a retaining spring 100. An o-ring seal 102 is provided in region 94 at the entrance to conduit 96.

Under cold start-up conditions, bimetallic disc 98 is in its open position, as shown in FIG. 4, to permit atmospheric air to be in communication with headspace 68 of carburetor fuel bowl 40 via air inlet conduit 92, conduit region 94, air outlet conduit 96, tubing conduit 87, restricted passageway 82, internal cavity 72, and communication slot 70. Preferably, the external vent passageway is sized and configured such that it completely overrides the internal venting system described above upon cold engine startup. When the engine is initially primed, a relatively rich fuel mixture is forced through nozzle conduit 62 into venturi 66 from which the rich fuel/air mixture is drawn into the intake manifold to aid in starting the engine. Since in externally vented carburetors, the difference between the air pressure in the carburetor throat and the atmosphere external of the carburetor is relatively great, a continuous flow of fuel from fuel bowl 40 into venturi 66 is provided so that the engine will continue operating without additional priming.

As the engine continues to operate and heat up, metal cowling 12 heats up, and such heat is transferred to valve 86 attached thereto. As the engine reaches a predetermined temperature, bimetallic disc 98 snaps into its closed position as shown in FIG. 5, whereby an airtight seal is formed between disc 98 and o-ring 102 to prevent the flow of atmospheric air into conduit 96. This predetermined temperature may vary depending on the particular characteristics of the engine as well as the environment in which the engine is utilized. For example in a 9 cubic inch vertical crankshaft engine for use in a lawn mower, one such preferred temperature is 90° F.

Once the predetermined temperature has been reached and valve 86 is in its closed position, venting of fuel bowl 40 occurs exclusively via the internal venting arrangement described above. Thus, the pressure in fuel bowl headspace 68 is reduced since the headspace is no longer vented to the outside atmosphere, but rather to the air inlet bore of the carburetor, which is at a lower pressure due to the pressure drop across the air cleaner element. The reduced pressure in headspace 68 reduces the differential pressure between headspace 68 and venturi 66, which results in a reduction of fuel being fed into venturi 66. Thus a leaner fuel/air mixture is provided, thereby lowering engine emissions to acceptable levels.

Although a particular type of bimetallic disc is shown, any bimetallic material may be used as long as it can be configured into a shape such that the temperature effects on the bimetal piece provide a motion that opens and closes a sealing member. In addition, an umbrella shaped check valve may be used in place of the o-ring seal in valve 86.

Figure 6:
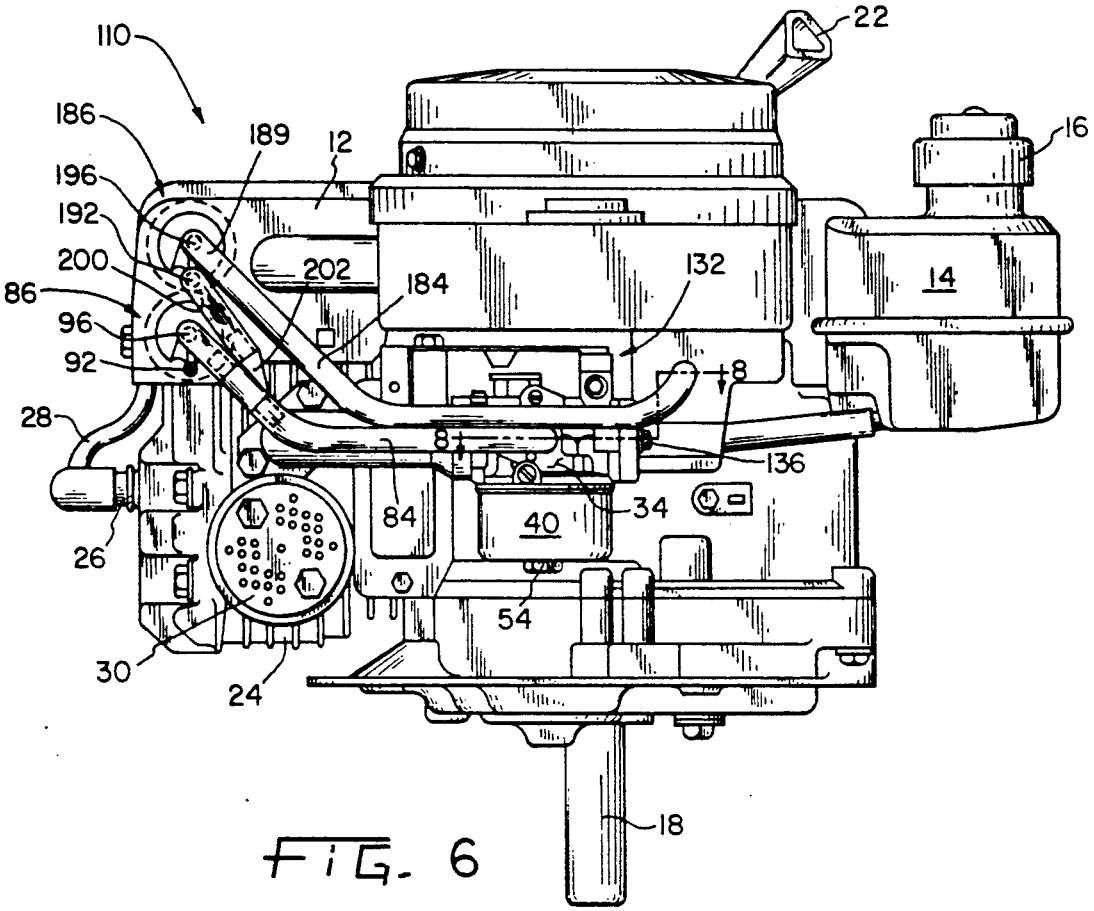
FIG. 6 is a front elevational view of an alternative embodiment to the small internal combustion engine of FIG. 1.
Figure 7:
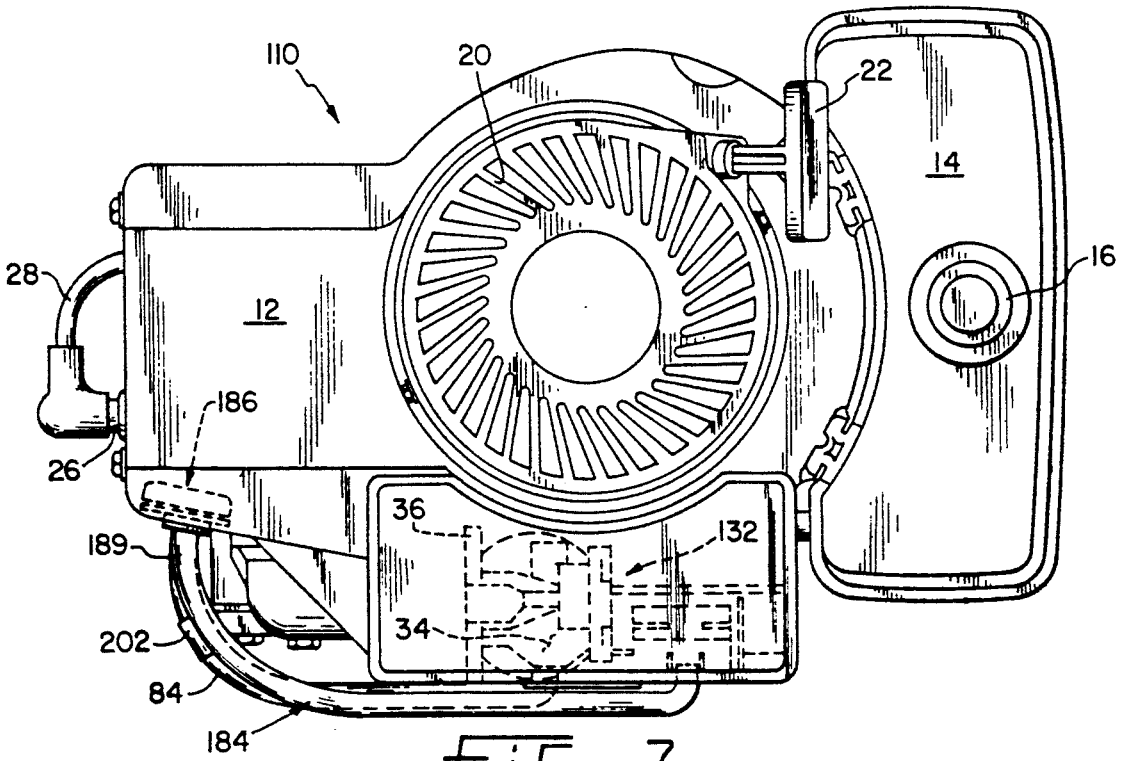
FIG. 7 is a top view of the engine of FIG. 6.
Figure 8:
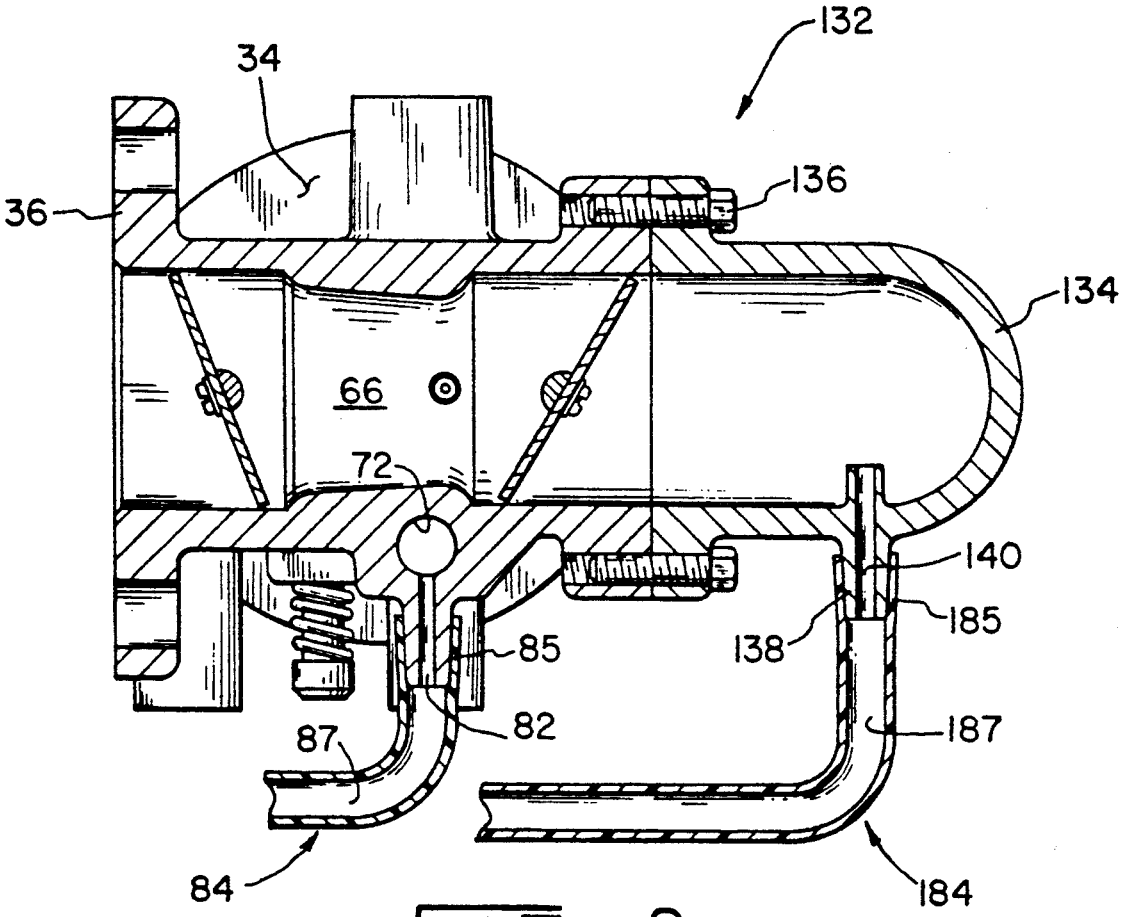
FIG. 8 is an enlarged sectional view of the carburetor of the engine in FIG. 6, taken along line 8—8 in FIG. 6.

Referring now to FIGS. 6–8, engine 110 is shown, which is an alternative embodiment to engine 10. In this embodiment, both the internal venting system and the external venting system are subject to being switched off and on based upon engine temperature. Engine 110 includes a carburetor 132 having an air cleaner housing 134 bolted to carburetor body 34 via bolts 136. Referring to FIG. 8, air cleaner housing 134 includes a boss portion 138 having a passageway 140 therein. One end 185 of a flexible tube 184 is secured to boss 138 such that passageway 187 of tube 184 is in air communication with passageway 140.

Referring to FIGS. 6 and 7, the opposite end 189 of tube 184 is secured to conduit 196 of a thermal valve 186. Thermal valve 186, which is also secured to housing 12 is structurally similar to valve 86 and, therefore, a detailed discussion of valve 186 is not necessary. For purposes of clarity, valve 186 is said to be in its closed position when bimetallic disc 98 is sealed against O-ring 102 (FIG. 5), and valve 186 is said to be in its open position when disc 98 is spaced from O-ring 102 (FIG. 4). A short flexible tube 200 is provided for communication of air between tubular passageways 87 and 187. In particular, tube 200 includes a first end that is secured to conduit 192 of valve 186 and an opposite end that is secured to tube 84 via a conventional tee-joint 202.

In operation, when the engine is cold, valve 186 is closed, and valve 86 is open so that headspace 68 is externally vented to the atmosphere via tube 84, which aids in starting the engine. After the engine has been started and reaches a predetermined temperature, such as 60° F., thermal valve 186 opens such that headspace 68 is vented both externally through tube 84, and also internally through tube 184, valve 186, tube 200, and tube 84. As the engine continues to warm up, a higher predetermined temperature is reached, such as 90° F. At such temperature, valve 86 moves into a closed position, thereby preventing the communication of air between the atmosphere external of the carburetor and headspace 68. Thus, headspace 68 is vented only to the carburetor bore. This embodiment provides a greater operating temperature range than the first embodiment.

It will be appreciated that the foregoing is presented by way of illustration only, and not by way of any limitation, and that various alternatives and modifications may be made to the illustrated embodiment without departing from the spirit and scope of the invention.

What is claimed is:

1. A carburetor for providing a fuel/air mixture to an internal combustion engine, comprising:

a carburetor body having a bore formed therein, said bore including an air inlet passage having an air inlet opening defining a fuel/air mixture passage, wherein a vacuum condition exists in said bore upon engine operation;

a float-regulated fuel supply bowl adapted to contain a quantity of liquid fuel and having a headspace above said fuel;

a fuel nozzle for conveying fuel from said fuel supply bowl to said fuel/air mixture passage;

an internal vent passageway for providing air communication between said headspace and said bore;

an external vent passageway extending from said headspace to the atmosphere external of the carburetor; and a thermally-actuated valve in said external vent passageway, said valve being in an open position while the temperature of the engine is less than a given temperature, thereby permitting said headspace to be in direct communication with the atmosphere, said valve being moved to a closed position upon the attainment of said given temperature, thereby preventing said headspace to be in direct communication with the atmosphere.

2. The carburetor of claim 1, wherein said valve comprises a bimetallic disc and an o-ring seal, wherein said disc is in spaced relationship to said o-ring seal while said valve is in said open position and said disc is in an airtight sealing relationship with said o-ring seal while said valve is in said closed position.

3. The carburetor of claim 1, wherein said external vent passageway comprises a restricted passageway formed in said carburetor body and a flexible tube external of said carburetor, said flexible tube including a tubed passageway therein that is in air communication with said restricted passageway.

4. The carburetor of claim 3, wherein said valve comprises a conduit having a first end attached to said flexible tube and a second opposite end that is open to the atmosphere.

5. The carburetor of claim 1, wherein the engine includes a metal cowling for housing the upper portion of the engine,, wherein said valve is secured to said metal cowling.

6. A carburetor for providing a fuel/air mixture to an internal combustion engine, comprising:

a carburetor body having a bore formed therein, sid bore including an air inlet passage having an air inlet opening defining a fuel/air mixture passage, wherein a vacuum condition exists in said bore upon engine operation;

a float-regulated fuel supply bowl adapted to contain a quantity of liquid fuel and having a headspace above said fuel;

a fuel nozzle for conveying fuel from said fuel supply bowl to said fuel/air mixture passage;

a vent passageway for venting excess pressure from said headspace to said bore; and thermally-actuated bowl venting means for overriding the venting effect of said vent passageway while the temperature of the engine is less than a given temperature, wherein said bowl venting means ceases to override the venting effect of said vent passageway upon the attainment of said given temperature.

7. A carburetor for providing a fuel/air mixture to an internal combustion engine, comprising:

a carburetor body having a bore formed therein, said bore including an air inlet passage having an air inlet opening defining a fuel/air mixture passage, wherein a vacuum condition exists in said bore upon engine operation;

a float-regulated fuel supply bowl adapted to contain a quantity of liquid fuel and having a headspace above said fuel;

a fuel nozzle for conveying fuel from said fuel supply bowl to said fuel/air mixture passage;

an internal vent passageway for providing air communication between said headspace and said bore;

an external vent passageway extending from said headspace to the atmosphere external of the carburetor;

a first thermally-actuated valve in said internal vent passageway, said valve being in a closed position while the temperature of the engine is less than a first given temperature, thereby preventing said headspace to be in communication with said bore, said first valve being moved to an open position upon attainment of said first given temperature, thereby permitting said headspace to be in communication with said bore; and a second thermally-actuated valve in said external vent passageway, said valve being in an open position while the temperature of the engine is less than a second given temperature, thereby permitting said headspace to be in direct communication with the atmosphere, said valve being moved to a closed position upon the attainment of said second given temperature, thereby preventing said headspace to be in direct communication with the atmosphere.

8. An internal combustion engine comprising:

a crankcase including a metal cowling;

a cylinder in said crankcase;

a carburetor for providing a fuel/air mixture to the cylinder, said carburetor comprising a carburetor body having a bore formed therein, said bore including an air inlet passage having an air inlet opening defining a fuel/air mixture passage, wherein a vacuum condition exists in said bore upon engine operation, said carburetor further including a float regulated fuel supply bowl adapted to contain a quantity of liquid fuel having a headspace above said fuel and a fuel nozzle for conveying fuel from said fuel supply bowl to said fuel/air mixture passage;

an external vent passageway extending from said headspace to the atmosphere external of the carburetor;

a thermally actuated valve attached to said metal cowling;

a flexible tube extending from said external vent passageway to said valve, said tube having a tubular passageway in air communication with said external vent passageway and a conduit in said valve;

wherein said valve is in an open position while the temperature of the metal cowling is less than a given temperature, thereby permitting said headspace to be in direct communication with the atmosphere, and said valve is in a closed position upon the attainment of said given temperature, thereby preventing said headspace to be in direct communication with the atmosphere.

9. The engine of claim 8 including:

an air cleaner element attached to said carburetor for filtering the air entering said carburetor bore;

a second flexible tube having a first end secured to and in air communication with said air cleaner element and a second opposite end secured to and in air communication with a first conduit in a second thermally actuated valve attached to said metal cowling;

a third flexible tube in air communication with a second conduit in said second valve and said first tube;

said valve being in a closed position while the temperature of the engine is less than a second given temperature, said valve being in an open position upon the attainment of said second given temperature.

10. The engine of claim 9, wherein said second given temperature is less than said first given temperature.

* * * * *